US005170541A

United States Patent [19]

Chen

[11] Patent Number: 5,170,541

[45] Date of Patent: Dec. 15, 1992

[54] FASTENING APPARATUS FOR HANDBAG STRAPS

[76] Inventor: Charles Chen, No. 70-5, Yueh-Hu Rd., Tun-Pei Ts'un, Hou-Li Hsiang, Taichung Hsien, Taiwan

[21] Appl. No.: 728,612

[22] Filed: Jul. 11, 1991

[51] Int. Cl.[5] ..... A44B 11/26

[52] U.S. Cl. ..... 24/613; 24/656

[58] Field of Search ..... 24/613, 612, 652, 656; 383/15; 220/326; 16/111 R, 125

[56] References Cited

U.S. PATENT DOCUMENTS

| | | | |
|---|---|---|---|
| 1,468,848 | 9/1923 | Wear | 383/15 X |
| 2,580,769 | 1/1952 | Harman | 24/613 |
| 2,800,940 | 7/1957 | Riesebeck | 383/15 X |
| 3,912,140 | 10/1975 | Franges | 383/15 X |
| 4,514,876 | 5/1985 | Houlberg | 383/15 X |

*Primary Examiner*—James R. Brittain

*Attorney, Agent, or Firm*—Ladas & Parry

[57] ABSTRACT

An apparatus for fastening a pair of handbag handling straps includes a longitudinal first grip member fixed to one handling strap and a longitudinal second grip member fixed to the other handling strap. The first grip member has a first face including a recessed receiving portion which has a curved portion. The second grip member includes a second face which is opposite and complementary to the first face. The second face has an outwardly projecting hood which extends into the recessed receiving portion and is movable in a longitudinal direction of the second face. A resilient member is provided in the second grip member to urge the hook to move in the longitudinal direction to engage with the curved portion when the first and second faces are engaged with each other. An releasing device is provided in the first grip member to release the hook from its engaging position.

1 Claim, 4 Drawing Sheets

FASTENING APPARATUS FOR HANDBAG STRAPS

BACKGROUND OF THE INVENTION

1. Field of the Invention

This invention relates to a handbag, more particularly to an apparatus for fastening a pair of handbag handling straps.

2. Description of the Related Art

Referring to FIGS. 1(A) and 1(B), a conventional handbag (1) includes a pair of handling straps (1*a*). The pair of handling straps (1*a*) has a soft grip strap member (1*b*) provided with a velcro fastener (1*c*) to fasten the handling straps (1*a*) together. One disadvantage with this mold is that it is inconvenient to interengage the velcro fastener (1*c*) with one hand and can not quickly fasten the handling straps (1*a*) together. On the other hand, the grip strap member (1*b*) is not held tightly against the handling straps (1*a*) so that it easily moves away from a proper gripping position along the handling straps (1*a*).

SUMMARY OF THE INVENTION

Therefore, the objective of this invention is to provide an apparatus for fastening a pair of handbag handling straps. The apparatus is of a snap-in type so that it easily, quickly, and firmly fastens the handbag handling straps together.

Accordingly, an apparatus of this invention for fastening a pair of handbag handling straps includes a longitudinal first and a longitudinal second grip member which are made of flexible plastics. The first grip member is fixed to one of the handbag handling straps and includes a first face which has a recessed receiving portion formed thereon. The recessed receiving portion has a curved portion therein.

The longitudinal second grip member is fixed to the other of the handbag handling straps. The second grip member includes a second face which is opposite and complementary to the first face. The second face has a hook projecting therefrom. The hook extends into the recessed receiving portion of the first face and is movable in a longitudinal direction of the second face.

A resilient member is provided in the second grip member to urge the hook to move in the longitudinal direction to engage with the curved portion of the recessed receiving portion when the first and second faces are engaged with each other. The fastening apparatus further includes means for releasing the hook from its engaging position provided in the first grip member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1A:
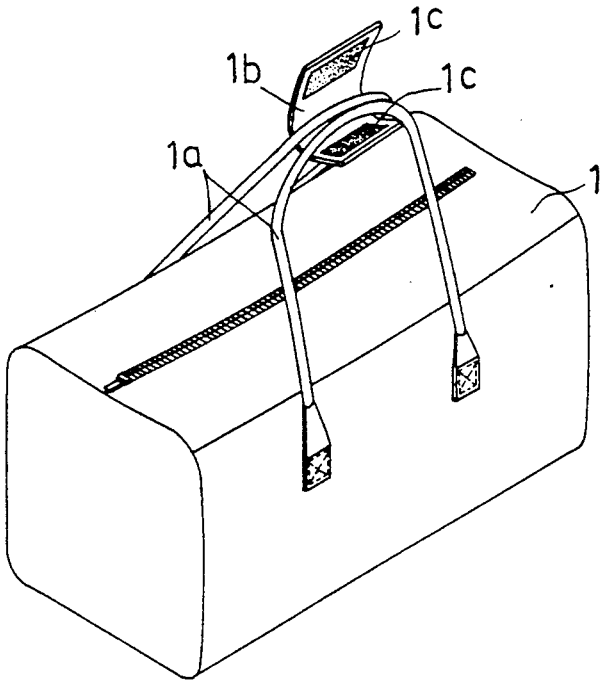
FIG. 1(A) PRIOR ART
FIG. 1(A) and 1(B) show a conventional handbag having a grip strap member provided with a velcro fastener.
Figure 1B:
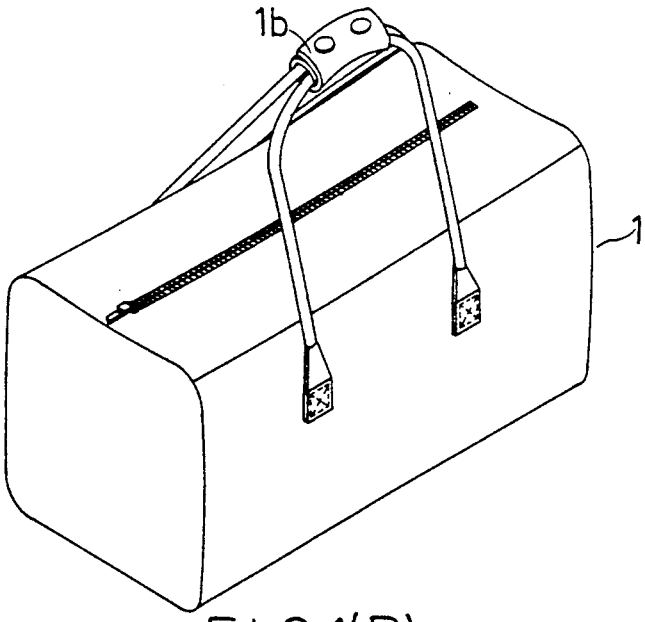
FIG. 1(B) PRIOR ART
Figure 2:
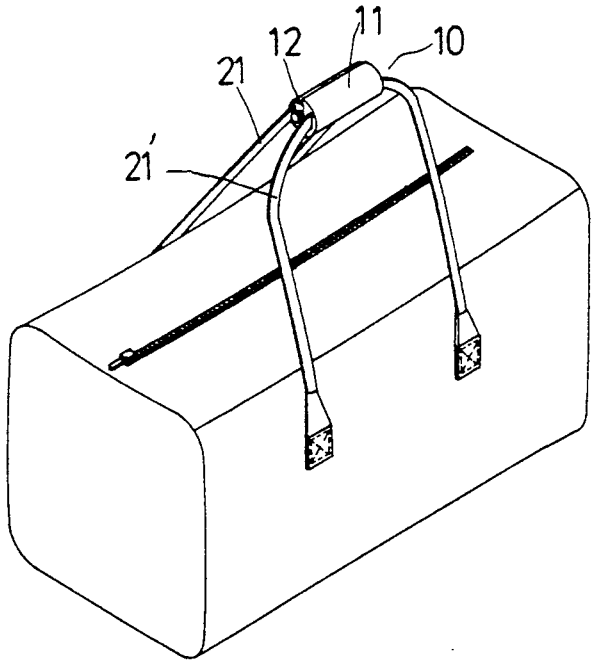
FIG. 2 is a schematic view of a handbag provided with a preferred embodiment of the fastening apparatus of this invention.
Figure 3:
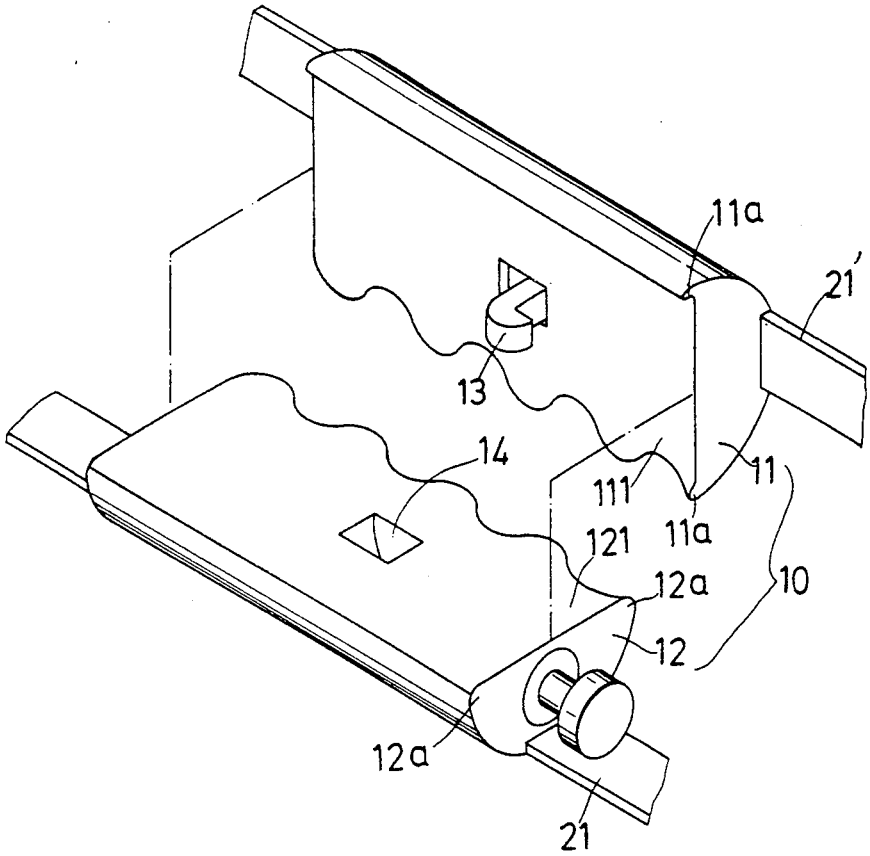
FIG. 3 is an exploded view of the preferred embodiment.
Figure 4:
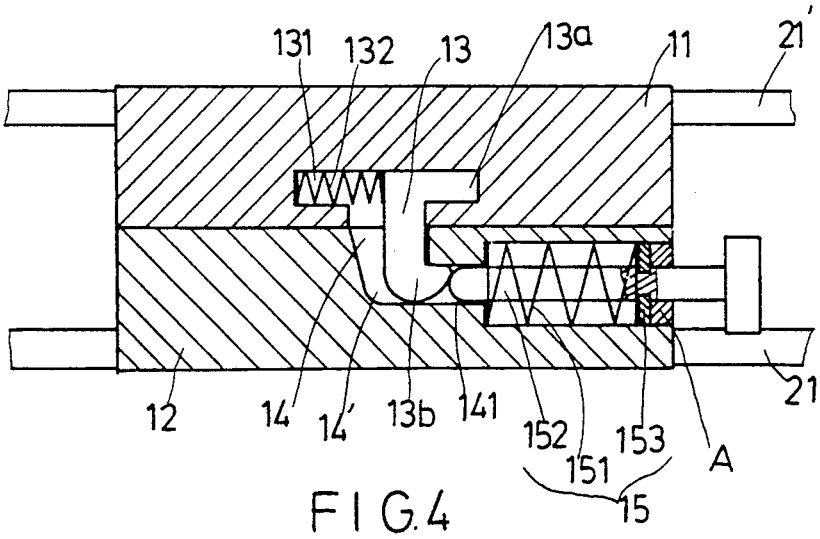
FIG. 4 is a sectional assembled view of the preferred embodiment.

Referring to FIGS. 2–4, an apparatus (10) for fastening a pair of handbag handling straps (21, 21') includes a longitudinal first grip member (12) fixed to one handbag handling strap (21), and a longitudinal second grip member (11) fixed to the other handbag handling strap (21'). The first and second grip members (12, 11) are made of a flexible plastic material and are injection-molded pieces. The first grip member (12) includes a first flat face (121) which has a first recessed receiving portion (14) formed thereon. The first recessed receiving portion (14) has a curved portion (14') therein. The first grip member (12) further has a longitudinally extending bore (141) communicating with the first recessed receiving portion (14).

The second grip member (11) includes a second flat face (111) which is opposite and complementary to the flat first face (121). The second face (111) includes a second recessed receiving portion (131), and a hook (13) which has a first end (13*a*) received in the second recessed receiving portion (131) and a second end (l3*b*) projecting out of the second face (111) and extending into the first recessed receiving portion (14). The hook (13) is movable in a longitudinal direction of the second face (111). A spring (132) is provided in the second recessed receiving portion (131) to urge the hook (13) to move in the longitudinal direction and to make the second end (13*b*) of the hook (13) engage with the curved portion (14') of the first recessed receiving portion (14) when the first and second faces (121, 111) are engaged with each other.

A releasing means (15) provided in the first grip member (12) includes a push rod (152) movably mounted in the bore (141). The push rod (152) includes an inner end to inwardly push the second end (13*b*) of the hook (13) so as to release it from its engaging position, and an outer end projecting outwards from the bore (141). The releasing means (15) further includes a stop member (A) fixed mounted in the wall of the bore (141) adjacent to the outermost of the bore (141), a ring member (153) mounted on the push rod (152) to prevent the push rod (152) from being released out of the bore (141), and a spring member (151) mounted between the ring member (153) and the inner end of the push rod (152) to urge the outer end of the push rod (152) outwards from the bore (141).

Figure 5:
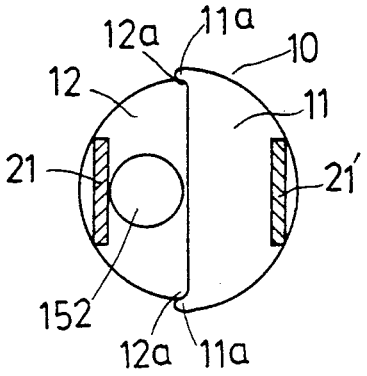
FIG. 5 is a side view of the preferred embodiment.
Figure 6:
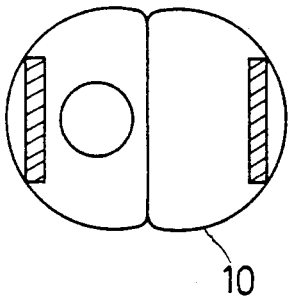
FIG. 6 is a side view of an another preferred embodiment of the fastening apparatus of this invention.

Also referring to FIG. 5, the second grip member (11) has two longitudinal flanged edges (11*a*) which extend over the edges (12*a*) of the first grip member (12). The fastening apparatus (10) of this invention can also have a shape shown in FIG. 6.

When putting the first and second grip members (12, 11) together, the hook (13) is easily, quickly, and firmly engaged in the first recessed receiving portion (14). The first and second grip members (12, 11) are fixed to the pair of handbag handling straps (21, 21'), and can not move relative to the handbag handling straps (21, 21'), so that the handbag handling straps (21, 21') are securely bond at a proper position for gripping.

Due to the first and second grip members (12, 11) being made of a flexible plastic material, the fastening apparatus (10) provides a soft and comfortable feeling.

In addition, the fastening apparatus (10) can have a variety of shapes and sizes to satisfy the user's needs.

While the present invention has been described in connection with what is considered the most practical and preferred embodiment, it is understood that this invention is not limited to the disclosed embodiment, but is intended to cover various arrangements included within the spirit and scope of the broadest interpretations and equivalent arrangements.

I claim:

1. An apparatus for fastening a pair of handbag handling straps, said apparatus comprising:

a longitudinal first grip member fixed to one of said handbag handling straps, said first grip member being made of a flexible plastic material and including a first face which has a recessed receiving portion formed thereon, and a longitudinally extending bore communicating with said recessed receiving portion, said recessed receiving portion having a curved portion therein;

a longitudinal second grip member fixed to the other of said handbag handling straps, said second grip member being made of a flexible plastic material and including a second face which is opposite and complementary to said first face, said second face having a hook projecting therefrom, said hook extending into said recessed receiving portion of said first face and being movable in a longitudinal direction of said second face;

a resilient member provided in said second grip member to urge said hook to move in said longitudinal direction to engage with said curved portion of said recessed receiving portion when said first and second faces are engaged with each other;

and means for releasing said hook from its engaging position, said releasing means provided in said first grip member, and including a push rod movably mounted in said bore, said push rod including an inner end to inwardly push said hook released from said engaging position and an outer end projecting outwards from said bore, said releasing means further having a spring member to urge said outer end of said push rod outwards from said bore.

* * * * *